United States Patent [19]

Chen

[11] Patent Number: 5,043,625

[45] Date of Patent: Aug. 27, 1991

[54] SPHERICAL ABERRATION-CORRECTED INLINE ELECTRON GUN

[75] Inventor: Hsing-Yao Chen, Barrington, Ill.

[73] Assignee: Zenith Electronics Corporation, Glenview, Ill.

[21] Appl. No.: 438,384

[22] Filed: Nov. 15, 1989

[51] Int. Cl.[5] ..... H01J 29/48

[52] U.S. Cl. ..... 313/414; 313/449

[58] Field of Search ..... 313/409, 412, 414, 449, 313/458, 460

[56] References Cited

U.S. PATENT DOCUMENTS

| | | | |
|---|---|---|---|
| 2,801,363 | 7/1957 | Sonnenfeldt | 315/22 |
| 2,957,106 | 10/1960 | Moodey | 315/13 |
| 3,412,281 | 11/1968 | Richards, Jr. et al. | 315/22 |
| 3,448,316 | 6/1969 | Yoshida et al. | 313/69 |
| 3,772,554 | 11/1973 | Hughes | 313/69 C |
| 3,952,224 | 4/1976 | Evans, Jr. | 313/414 |
| 3,995,194 | 11/1976 | Blacker, Jr. et al. | 315/16 |
| 4,058,753 | 11/1977 | Blacker et al. | 315/368 |
| 4,061,941 | 12/1977 | Hallett et al. | 313/414 |
| 4,234,814 | 11/1980 | Chen et al. | 313/412 |
| 4,242,613 | 12/1980 | Brambring et al. | 313/447 |
| 4,319,163 | 3/1982 | Chen | 315/14 |
| 4,334,169 | 6/1982 | Takenaka et al. | 313/414 |
| 4,366,414 | 12/1982 | Hatayama et al. | 313/409 |
| 4,400,649 | 8/1983 | Chen | 313/414 |
| 4,473,775 | 9/1984 | Hosokoshi et al. | 315/14 |
| 4,513,222 | 4/1985 | Chen | 313/412 |
| 4,520,292 | 5/1985 | van Hekken et al. | 313/412 |
| 4,523,123 | 6/1985 | Chen | 313/412 |
| 4,629,933 | 12/1986 | Bijma et al. | 313/414 |
| 4,641,058 | 2/1987 | Koshigoe et al. | 313/449 |
| 4,704,565 | 11/1987 | Blacker, Jr. et al. | 315/382 |
| 4,771,216 | 9/1988 | Blacker et al. | 315/382 |
| 4,825,120 | 4/1989 | Takahashi | 313/414 |

FOREIGN PATENT DOCUMENTS 0178857 4/1986 European Pat. Off. .

OTHER PUBLICATIONS 10.2; Progressive-Scanned 33-in. 110° Flat-Square Color CRT, Suzuki et al., pp. 166-169, SID 87 Digest.

2.1 In-Line Gun with Dynamic Astigmatism and Focus Correction, Ashizaki et al., pp. 44-47, Japan Display, '86.

10.1 Quadrupole Lens for Dynamic Focus and Astigmatism Control in an Eliptical Aperture Lens Gun, Shirai et al., pp. 162-165, SID 87 Digest.

8.5 Dynamic Astigmatism Control Quadra Potential Focus Gun for 22-in. Flat Square Color Display Tube, Katsuma et al., pp. 136-139, SID 88 Digest.

P1.13 An In-Line Color CRT with Dynamic Beam Shaping for Data Display, Yamane et al., pp. 160-163, Japan Display, '86.

An In-Line Gun for High-Resolution Color Display, H. Y. Chen, pp. 123-127, Proceedings of the SID, vol. 23/3, 1982.

THPM 10.1: A New Generation of Color CRT Electron Gun Design, Chen et al., pp. 126-127, ICCE 83/Jun. 9, 1983, Digest of Technical Papers.

An Overview of the COTY-29 Tube System/An Improved Generation of Color Picture Tubes, Morrell, pp. 290-295, IEEE Transactions on Consumer Electronics, vol. CE-28, No. 3, Aug. 1982.

*Primary Examiner*—Sandra L. O'Shea

[57] ABSTRACT

An inline electron gun for a multi-beam color cathode ray tube (CRT) corrects for green (center) electron beam vertical spherical aberration by enlarging the vertical dimension of the center portions of common lens apertures in adjacent grids in the electron gun. Increasing the vertical dimension of that portion of each of the aforementioned grid apertures through which the green electron beam transits reduces the vertical spot size of the green beam without degrading other electron gun operating characteristics. The inventive grid aperture arrangement is particularly adapted for use in a combined optimum tube and yoke (COTY) color CRT.

18 Claims, 1 Drawing Sheet

SPHERICAL ABERRATION-CORRECTED INLINE ELECTRON GUN

BACKGROUND OF THE INVENTION

This invention relates generally to multi-electron beam color cathode ray tubes (CRTs) and is particularly directed to an inline electron gun arrangement for correcting for spherical aberration in a color CRT.

Most color CRTs employ an inline electron gun arrangement for directing a plurality of electron beams on the phosphorescing inner screen of a glass faceplate. The inline electron gun approach offers various advantages over earlier "delta" electron gun arrangements particularly in simplifying the electron beam positioning control system and essentially eliminating the tendency of the convergence to drift. However, inline color CRTs employ a self-converging deflection yoke which applies a nonuniform magnetic field to the electron beams, resulting in an undesirable astigmatism in and defocusing of the deflected electron beam spot displayed on the CRT's faceplate. Various solutions offering a range of degrees of success have been proposed for minimizing or eliminating these two performance limitations of inline CRTs.

One of the disadvantages of the inline electron gun is the reduced lens diameter compared to a "delta" gun which causes inferior beam spot size. The ability of the electron gun to form small, symmetrical beam spots is a major factor in achieving optimum video image resolution. Incorporating this capability in present CRTs has become an even greater challenge because of reduction in the diameter in the CRT neck brought about primarily by space constraints. Reducing CRT neck diameter limits the size of the individual electron lens elements and their ability to form small, sharply defined spot images on the CRT's faceplate. The solution to the problem of providing a high resolution video image is thus complicated not only by the limited ability of the electron gun to form three separate, very small and precisely defined beam spot images, but also by the requirement to mutually converge the three spot images with the variation in the spread of the beam spots with their position on the CRT faceplate.

Recent developments in CRT design have lead to an electron gun employing an open main lens for reducing spherical aberration while improving electron beam spot size. A CRT incorporating this type of electron gun is referred to as a COTY (for combined optimum tube and yoke) CRT and employs a bipotential main lens having a pair of complementary electrodes, or grids, each having a respective common lens arranged in adjacent, facing relation. The common lens portions of adjacent lens elements provide a substantial increase in horizontal lens aperture size for reducing horizontal spherical aberration. Although also affording improvements in beam focusing and astigmatism correction, COTY-type CRTs suffer from various limitations. For example, its center electron gun exhibits greater spherical aberration in the vertical direction than the two outer guns. This appears as a larger green vertical spot size than that of the red and blue electron guns and limits video image resolution and degrades color purity. The COTY-type CRT incorporates a G3 grid having an elongated, "racetrack" shaped aperture and a G4 grid having a "dog bone" shaped elongated aperture enlarged at both ends in the common lens portions of these grids through which all three electron beams are directed.

The present invention overcomes the aforementioned limitations of prior art inline electron guns, by reducing the vertical spot size of the green color producing electron beam so as to reduce vertical spherical aberration and improve video image quality without sacrificing other performance parameters in an inline color CRT.

OBJECTS OF THE INVENTION

Accordingly, it is an object of the present invention to provide spherical aberration correction in an inline electron gun in a color CRT.

Another object of the present invention is to reduce center (or green) electron beam spot size in a COTY-type CRT in correcting for spherical aberration in a color CRT.

Yet another object of the present invention is to improve video image quality in a color CRT by correcting for vertical spherical aberration for the green beam without compromising other CRT performance criteria.

Still another object of the present invention is to provide a back-to-back grid arrangement particularly adapted for use in a COTY-type CRT which corrects for video image vertical spherical aberration for the green beam in a color CRT.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DESCRIPTION OF THE PREFERRED EMBODIMENTS

Figure 1:
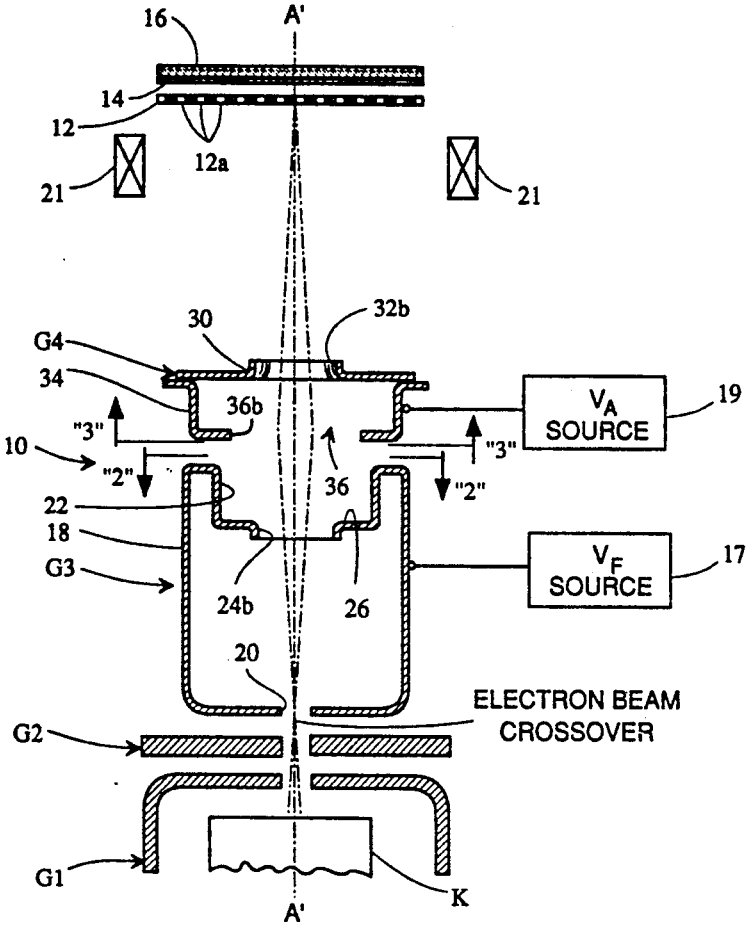
FIG. 1 is a simplified sectional view of an electron gun in accordance with the principals of the present invention as employed in a color CRT.

Referring to FIG. 1, there is shown a simplified sectional view of a spherical aberration-corrected inline electron gun 10 in accordance with the principals of the present invention. The present invention is particularly adapted for spherical aberration reduction in a combined optimum tube and yoke (COTY) CRT. A COTY-type CRT employs an inline electron gun and allows the three electron guns to have a larger vertical lens while sharing the horizontal open space in the main lens for improved spot size.

The inline electron gun 10 includes an electron beam source typically comprised of a cathode K. The cathode K is typically comprised of a sleeve, a heater coil, and an emissive layer (none of which are shown in FIG. 1 for simplicity), from which emitted electrons are focused to a crossover along the axis of the beam A—A' by the effect of a grid commonly referred to as the G2 grid. A control grid known as the G1 grid is disposed between the cathode K and the G2 grid and is operated at a negative potential relative to the cathode K and serves to control the intensity of the electron beam response to the application of a video signal thereto, or to the associated cathode. The aforementioned electron beam's first crossover is at that point where the electrons pass through the axis A—A' and is typically in the vicinity of the G2 grid. The terms "voltage" and "potential" are used interchangeably in the following paragraphs. Similarly, while various of the elements in the electron gun 10 are referred to as "grids", they could as equally as well be referred to as "electrodes" as these terms have the same general meaning in the context of the relevant arts to which the present invention relates.

The electron gun 10 includes additional charged grids coaxially aligned with the axis A—A' along which the electron beam is directed. While reference is made here to an electron beam, it should be noted that the electron gun 10 is intended for use with a plurality (generally three) electron beams as described in detail below. Thus, also disposed about the electron beam and along the path of the energetic electrons are a G3 grid, a G4 grid and a G5 grid. The aforementioned grids are each coupled to a voltage source which may be of either the focusing or accelerating type. Thus, as shown in FIG. 1, the G3 grid is coupled to a focus voltage ($V_F$) source 17, while the G4 grid is coupled to an accelerating anode voltage ($V_A$) source 19. The G3 and G4 grids form what is generally termed the "main lens" of the electron gun 10.

After being subjected to the electrostatic fields produced by the accelerating and focusing voltages applied by the aforementioned grids, the electron beam then is directed through a magnetic deflection yoke 21 which is typically of the self-converging type, for deflecting the electron beam in a periodic manner across a phosphor coating, or layer, 14 on the inner surface of the CRT's glass faceplate 16. Disposed adjacent to the inner surface of the CRT's faceplate 16 is a shadow mask 12 having a large number of apertures 12*a* therein. The shadow mask 12 serves as a color selection element for producing selective energization of predetermined color dots within the phosphor coating 14 by each of the respective electron beams. The accelerating voltage $V_A$ is substantially higher than the focus voltage $V_F$ and serves to cooperate with $V_F$ in the electron gun to accelerate the electrons toward the phosphor coated faceplate 16. $V_A$ is typically on the order of three to four times the magnitude of $V_F$, where $V_A$ generally has a value on the order of 30 KV and $V_F$ is on the order of 7-9 KV.

Figure 2:
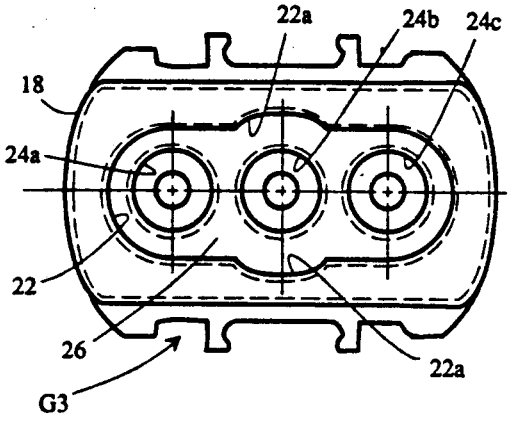
FIG. 2 is a sectional view of the electron gun arrangement of FIG. 1 taken along sight line 2—2 therein which illustrates a planar view of a G3 grid in the electron gun in accordance with the present invention.

Each of the grids is aligned with and coaxially disposed about the electron beam axis A—A'. Grids G3 and G4 are each provided with a pair of aligned apertures through which a respective one of the three electron beams passes as it is directed toward the faceplate 16. Referring to FIG. 1 as well as to FIG. 2, which is a plan view of the G3 grid taken along sight line 2—2 in FIG. 1, details of the structure and configuration of the G3 grid will now be described. The G3 grid includes a generally cylindrical housing having an outer side wall 18. The open first end of the G3 grid facing cathode K is provided with a generally circular aperture 20. The second end of the side wall 18 of the G3 grid facing the G4 grid is provided with an inward extending oval ridge 22. Extending inward from the oval ridge 22 toward the A—A' axis is an inner wall, or partition, 26 having three circular apertures 24*a*, 24*b* and 24*c* therein. The three circular apertures 24*a*, 24*b* and 24*c* are arranged in a linearly aligned, spaced manner along the inner wall 26. A respective one of each of the three electron beams is directed through each of the three circular apertures 24*a*, 24*b* and 24*c*. Typically, the red and blue color producing electron beams are directed through one of the end apertures, such as apertures 24*a* or 24*c*, while the green color producing electron beam is directed through the center aperture 24*b*.

In accordance with one aspect of the present invention, the oval ridge 22 forms an elongated, generally oval-shaped aperture in the second end of the G3 grid. This portion of the G3 grid is commonly referred to as the common lens portion of the grid because all three electron beams transit the elongated, oval-shaped aperture. Facing center portions of the oval ridge 22 are provided with enlarged portions 22*a* for increasing the vertical dimension of the oval-shaped aperture on the second end of the G3 grid adjacent to where the green, or center, electron beam passes. The enlarged center portions 22*a* of the oval ridge 22 provide an increased lens diameter for the green electron gun to allow for a reduction in the vertical dimension of the green beam spot size on the faceplate's phosphor coating 14. The reducing of the vertical spherical aberration of the center electron gun reduces the center beam's vertical spot size without diminishing other performance parameters of the electron gun. Prior art G3 grids in COTY-type CRTs incorporate an elongated "racetrack" shaped aperture in the common lens portion of the grid through which all three electron beams are directed, which prior art aperture does not include the inventive enlarged center portions.

Figure 3:
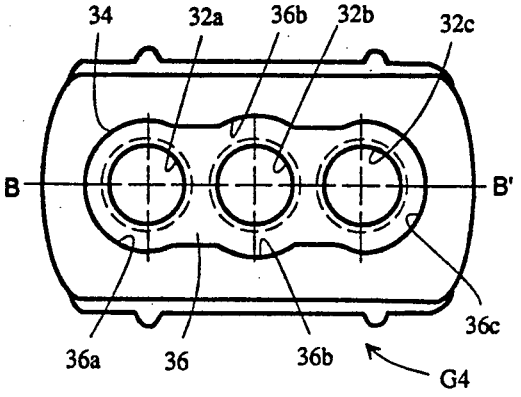
FIG. 3 is a sectional view of the electron gun shown in FIG. 1 taken along sight line 3—3 therein illustrating a planar view of a G4 grid in accordance with the present invention.

Referring now to FIG. 1 as well as to FIG. 3, which is a sectional view taken along sightline 3—3 in FIG. 1, additional details of the present invention relating to the structure and configuration of the G4 grid will now be described. The G4 grid includes a plurality of spaced, circular apertures 32*a*, 32*b* and 32*c* arranged in a linear array on a second end portion of the grid. Each of the circular apertures 32*a*, 32*b* and 32*c* is defined by a respective upraised lip 30 extending outward from the G4 grid toward the CRT faceplate 16. Each of the three circular apertures 32*a*, 32*b* and 32*c* allows for the passage of a respective one of the three electron beams, with the green electron beam generally transmitted through the center circular aperture 32*b*. The G4 grid further includes an outer side wall 34 defining a lateral periphery of the grid. A first end of the G4 grid is provided with an elongated aperture 36, having its longitudinal axis B—B' aligned with the linear array of the aforementioned circular apertures 32*a*, 32*b* and 32*c*. Respective ends of the elongated aperture 36 are provided with enlarged portions 36*a* and 36*c*. Electron beams directed through the outer circular apertures 32*a* and 32*c* are similarly directed through the respective enlarged end portions 36*a* and 36*c* of the elongated aperture 36. A center electron beam is similarly directed through the center circular aperture 32*b* and the center enlarged portions 36*b* of the elongated aperture 36. Each of the circular apertures in the G4 grid is aligned with a respective one of the circular apertures in the G3 grid. Thus, circular apertures 24*a* and 32*a*, 24*b* and 32*b*, and 24*c* and 32*c* are in mutual alignment such that one of the three electron beams is directed through each of the aforementioned pairs of aligned circular apertures. The enlarged portions 36*b* in facing intermediate portions of the elongated aperture provide an increased vertical dimension for the common lens portion of the G4 grid for the center electron beam.

As in the case of the expanded center portion of the oval aperture in the G3 grid, the center expanded portions 36b in the G4 grid provide a larger vertical focusing lens for the green color producing electron gun, thus the combined effect of the enlarged G3 and G4 common lens apertures permit the green electron beam to be focused to a smaller spot size on the faceplate's phosphorescing coating 14. Prior art G4 grids in COTY-type CRTs incorporate a "dog bone" shaped elongated aperture having enlarged end portions in the common lens portion of the grid through which all three electron beams are directed, which "dog bone" shaped aperture does not include the inventive center expanded portions.

There has thus been shown an improved electron gun which provides reduced spherical aberration in a multi-electron beam color CRT. The spherical aberration-corrected inline electron gun is particularly adapted for use in a COTY-type CRT in that it includes a pair of charged grids, having facing common lens portions, with each of the three electron beams directed through the combination of a circular aperture and an elongated aperture in each of the aforementioned grids. Facing center portions of the elongated aperture in each grid are enlarged to provide an enlarged aperture for the center, or green, electron beam in the vertical direction. The increased lens size for the green electron beam in the vertical direction allows for a reduction in the vertical dimension of the green beam spot size. This results in a corresponding improvement in video image without sacrificing other CRT performance characteristics.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. An electrode for an electron gun directing a center and two outer electron beams onto a screen of a cathode ray tube (CRT) in forming a video image on said screen, said electrode comprising:

a hollow housing having first and second end portions;

means for defining first, second and third circular apertures disposed within said housing and arranged in a linear, spaced array across said housing, wherein each of the electron beams is directed through a respective one of said circular apertures and all of said circular apertures are of the same size; and means for defining a fourth elongated aperture disposed on said first end portion of said housing and having a longitudinal axis aligned with the linear array of said circular apertures, said fourth aperture having an enlarged center portion through which the center electron beam passes for reducing spherical aberration of the center electron beam on the screen in a direction generally transverse to the longitudinal axis of said fourth aperture, said fourth aperture further including arcuate expanded portions on each end thereof aligned with a respective outer circular aperture in said housing for passing a respective one of the outer electron beams.

2. The electrode of claim 1 wherein said circular apertures are disposed on the second end portion of said housing.

3. The electrode of claim 1 wherein said circular apertures are disposed intermediate said elongated aperture and the screen of the CRT.

4. The electrode of claim 3 wherein the enlarged center portion of said elongated aperture includes a pair of expanded portions in facing relation on median, opposed portions of said elongated aperture.

5. The electrode of claim 4 wherein said elongated aperture is generally oval in shape.

6. The electrode of claim 5 wherein each of the expanded portions of said elongated oval aperture is of a generally arcuate shape and wherein the center electron beam passes intermediate the expanded, arcuate portions of the elongated oval aperture.

7. The electrode of claim 6 wherein said elongated oval aperture further includes arcuate expanded portions on each end thereof aligned with a respective outer circular aperture in said housing for passing a respective one of the outer electron beams.

8. The electrode of claim 1 wherein the electrode is a G4 grid in a color CRT and is coupled to an anode voltage source.

9. For use in a color cathode ray tube (CRT) having a self-converging magnetic deflection yoke and employing a center and a pair of outer electron beams arranged in inline alignment, wherein said electron beams are deflected across a phosphorescing screen in the CRT in a synchronous manner by said self-converging yoke, an electron gun comprising:

cathode means for generating electrons;

crossover means for receiving electrons from said cathode means and for forming a beam crossover; and first and second electrode means arranged in a spaced manner along the electron beams for applying an electrostatic field to the electron beams, wherein each of said electrode means includes three circular aligned apertures of the same size through each of which a respective one of the electron beams is directed and an elongated common lens portion through which all of said electron beams pass and wherein the common lens portions of said first and second electrode means are arranged in facing relation, each of said common lens portions having an enlarged intermediate portion through which the center beam passes for reducing spherical aberration in a direction generally transverse to the inline alignment of the electron beams and wherein said common lens portion of said second electrode means further includes expanded portions on each end thereof aligned with a respective outer electron beam for passing said respective outer electron beam.

10. The electron gun of claim 9 wherein the said first electrode means comprises a G3 grid and said second electrode means comprises a G4 grid in a combined optimum tube and yoke (COTY)-type color CRT.

11. The electron gun of claim 10 wherein said G3 grid is coupled to a focusing voltage source and said G4 grid is coupled to an accelerating voltage source.

12. The electron gun of claim 9 wherein each common lens portion of said first and second electrode means includes an elongated recessed portion disposed on a first end of said electrode means and having a longitudinal axis aligned with the inline alignment of the electron beams.

13. The electron gun of claim 9 wherein the three circular apertures in each of said first and second electrode means are aligned with and in spaced relation from the elongated recessed portion of their associated electrode means.

14. The electron gun of claim 13 wherein the enlarged intermediate portions of the common lens portions of each of said first and second electrode means include a pair of expanded portions in facing relation and on median, opposed portions of each of said elongated recessed portions of said electrode means.

15. The electron gun of claim 14 wherein the expanded portions of each of said electrode means are generally arcuate in shape, and wherein the center electron beam passes intermediate the expanded portions of the elongated recessed portion in each of said electrode means.

16. The electron gun of claim 15 wherein the elongated recessed portions of each of said first and second electrode means are generally oval shaped.

17. The electron gun of claim 16 wherein said first electrode means includes first and second opposed end portions, and wherein the elongated recessed portion of said first electrode means is disposed on a first end thereof and the three circular apertures of said first electrode means are disposed intermediate the first and second opposed ends thereof.

18. The electron gun of claim 17 wherein the elongated recessed portion of said second electrode means is disposed on a first end thereof and the three circular apertures of said second electrode means are disposed on a second, opposed end thereof.

* * * * *